US011472223B1

(12) United States Patent
Lovgren et al.

(10) Patent No.: US 11,472,223 B1
(45) Date of Patent: Oct. 18, 2022

(54) SCRIPT SIGN TEMPLATE APPARATUS AND METHOD

(71) Applicant: Rockler Companies, Inc., Medina, MN (US)

(72) Inventors: Sarah Jaqueline Lovgren, Maple Grove, MN (US); Brandon Michael Snyder, Buffalo, MN (US); Daniel Lloyd Wenning, Minnetonka, MN (US)

(73) Assignee: Rockler Companies, Inc., Medina, MN (US)

( * ) Notice: Subject to any disclaimer, the term of this patent is extended or adjusted under 35 U.S.C. 154(b) by 0 days.

(21) Appl. No.: 17/317,503

(22) Filed: May 11, 2021

Related U.S. Application Data

(60) Provisional application No. 63/025,413, filed on May 15, 2020.

(51) Int. Cl.
*B43L 13/20* (2006.01)

(52) U.S. Cl.
CPC ..... *B43L 13/208* (2013.01)

(58) Field of Classification Search
CPC ..... B43L 13/208
See application file for complete search history.

(56) References Cited

U.S. PATENT DOCUMENTS 159,725 A 2/1875 Warren
1,703,246 A 2/1929 Read
2,041,993 A 5/1936 Cousins
2,850,811 A 9/1958 Boley
3,140,548 A 7/1964 Paparozzi
3,584,385 A 6/1971 Booth
3,731,402 A * 5/1973 Paul ..... G09B 11/04 434/164

(Continued)

FOREIGN PATENT DOCUMENTS

GB 2071579 A * 9/1981 ..... B43L 13/208
GB 2071579 A 9/1981

OTHER PUBLICATIONS

"Interlock Signmaker's State Park Template Instructions", Effective Sep. 2019, Rockler® Woodworking and Hardware, Create with Confidence™, Distributed by Rockler Companies, Inc., Medina, Minnesota, 43820 48356 56091, Rev 09/19, 12 pages.

(Continued)

*Primary Examiner* — Yaritza Guadalupe-McCall
(74) *Attorney, Agent, or Firm* — Mai-Tram D. Lauer; Westman, Champlin & Koehler, PA

(57) ABSTRACT

A kit includes a plurality of templates, a first end spacer, and a first middle spacer. The templates are for use in creating corresponding letters, numbers or symbols. A first template has a first width. The first end spacer is configured to replace the first template in a subsequent pass in which the first template is at an end of a word, the first end spacer having a second width that is less than the first width. The first middle spacer is configured to replace the first template in the subsequent pass in which the first template is in a middle of the word, the first middle spacer having a third width that is less than the second width. A second template has a fourth width that is different from the first width. A method is described for forming a sequence of connected first and second letters on a workpiece.

20 Claims, 16 Drawing Sheets

(56) References Cited

U.S. PATENT DOCUMENTS

| | | | | |
|---|---|---|---|---|
| 4,125,658 | A * | 11/1978 | Miles | B43L 13/208 118/301 |
| 4,652,337 | A | 3/1987 | Picone et al. | |
| 4,731,149 | A | 3/1988 | Dowzall et al. | |
| 4,852,483 | A * | 8/1989 | Bussard | B41F 15/02 33/564 |
| 4,862,597 | A | 9/1989 | Drandell | |
| 4,867,056 | A | 9/1989 | de Gelder | |
| 4,916,826 | A | 4/1990 | McKeown | |
| 5,000,688 | A * | 3/1991 | Clamp | G09B 11/04 33/DIG. 1 |
| D393,482 | S | 4/1998 | Grannan et al. | |
| 5,761,060 | A | 6/1998 | Drew | |
| 6,686,935 | B1 | 2/2004 | Richard | |
| 6,820,546 | B2 * | 11/2004 | Wynne | B05B 12/24 101/127.1 |
| 6,829,748 | B1 | 12/2004 | Browne et al. | |
| 6,829,990 | B2 * | 12/2004 | Cochran | B41F 15/34 101/127.1 |
| 7,020,975 | B2 | 4/2006 | Ernst et al. | |
| 8,044,961 | B2 | 10/2011 | Opstad et al. | |
| 8,069,091 | B1 | 11/2011 | Callen, Jr. et al. | |
| 8,661,702 | B2 * | 3/2014 | Ihm | B44D 2/007 33/564 |
| D740,355 | S | 10/2015 | Kouthoofd | |
| 9,802,333 | B1 * | 10/2017 | Krohmer | G09F 7/00 |
| 10,486,053 | B2 * | 11/2019 | Schulte | A63B 71/06 |
| 10,576,654 | B1 * | 3/2020 | Krohmer | B27C 5/10 |
| 2003/0159601 | A1 * | 8/2003 | Wynne | B05B 12/24 101/128.21 |
| 2004/0221754 | A1 * | 11/2004 | Cochran | B41L 13/10 101/127.1 |
| 2012/0234482 | A1 * | 9/2012 | Ihm | B44D 2/007 156/349 |
| 2014/0014233 | A1 | 1/2014 | Grisley | |

OTHER PUBLICATIONS www.dafont.com, 3 pages, "Actonia Hand Font," publicly available at least as of Jul. 28, 2016.

"Interlock Signmaker's State Park Template Instructions", Rockler® Woodworking and Hardware, Create with Confidence™, Distributed by Rockler Companies, Inc., Rev 10/12, © 2012, 5 pages.

* cited by examiner

A B C D E F G H I
J K L M N O P Q R
S T U V W X Y Z

FIG. 1 a b c d e f g h i j k l m n
o p q r s t u v w x y z

FIG. 2

0 1 2 3 4 5 6 7 8 9
. ! ? , ' - / @ # $ &

FIG. 3

SCRIPT SIGN TEMPLATE APPARATUS AND METHOD

CROSS REFERENCE TO RELATED APPLICATIONS

This application claims the benefit of priority from U.S. Provisional Application No. 63/025,413, filed on May 15, 2020; this priority application is fully incorporated herein.

BACKGROUND

Many people who enjoy woodworking like to make signs where the letters, numbers and/or symbols are routed into the wood. Typically, a single template is utilized to define the look and appearance of each letter, number and/or symbol. The templates are configured to be placed side by side, where each template typically has the same length and width. Using templates of the same length and width ensures the template spacing is uniform. While the template spacing maybe uniform, there are many times in which it may be beneficial to include varying spacing between the letters to provide a more visually appealing appearance.

The kerning of the letters may be utilized to provide a more professional appearance. What is meant by kerning is changing the spacing between letters within a word. Words that typically could benefit from kerning include those with capital letters A, F, L, P, T, V and Y. Each of these letters has a characteristic where there is a difference in the width of the letter at the top versus the bottom. One of the more pronounced examples would be when the letters A and V are placed adjacent each other, as these letters have complementary slanted segments. Utilizing a typical template to make signs, the letters A and V would be spaced farther apart than necessary.

There also are letters or symbols that include islands that are difficult to make utilizing a router. What is meant by an "island" is a portion of a letter, number or symbol that is completely surrounded by a routed groove. A non-exhaustive list of letters of the English alphabet, symbols and numbers that have an island include A, B, D, O, P, Q, R, 4, 6, 8, 9, 0, #, &, and @. In order to route these symbols, numbers and letters into a piece of wood, a split in the island perimeter is typically utilized, where one or more bridges connect the island to the rest of the template. As such, the perimeter around the island is not continuous, resulting in the letter, number or symbol having an appearance that is not as professional compared to a letter, number or symbol of a typical letter not having an island.

SUMMARY

In one aspect, a kit includes a plurality of templates, a first end spacer, and a first middle spacer. The plurality of templates are for letters, numbers or symbols and are configured for use in creating corresponding letters, numbers or symbols on a workpiece. A first template of the plurality of templates has a first width. The first end spacer is configured to replace the first template in a subsequent pass in which the first template is at an end of a word, the first end spacer having a second width that is less than the first width. The first middle spacer is configured to replace the first template in the subsequent pass in which the first template is in a middle of the word, the first middle spacer having a third width that is less than the second width. A second template of the plurality of templates has a fourth width that is different from the first width.

In another aspect, a method of forming a sequence of connected first and second letters on a workpiece is described. The method includes obtaining a first template for the first letter, the first template including a first groove; obtaining a second template for the second letter, the second template including a second groove; placing the first template on the workpiece; marking in the first groove to form the first letter; removing the first template from the workpiece; placing the second template on the workpiece so that the second groove overlaps the first letter; and marking in the second groove to form a second routed letter that is connected to the first letter.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

FIG. 1 shows the capital letters of an exemplary script typeface for routing.

FIG. 2 shows the lowercase letters of an exemplary script typeface for routing.

FIG. 3 shows numerals and symbols for the exemplary script typeface for routing.

Figure 4A:
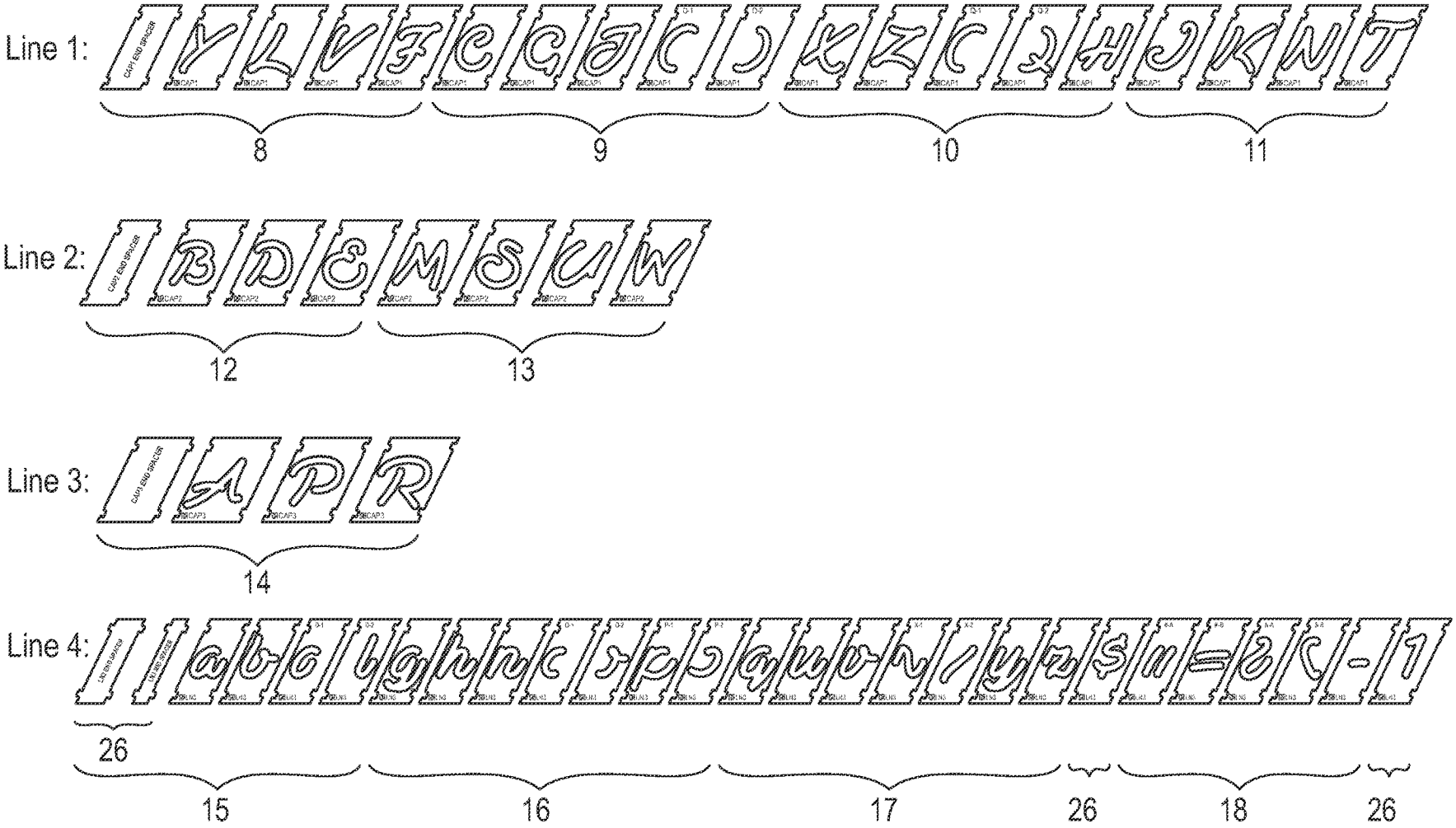
FIGS. 4A and 4B show the elements of an exemplary kit for routing letters, numbers and symbols of the typeface shown in FIGS. 1-3.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

DETAILED DESCRIPTION OF ILLUSTRATIVE EMBODIMENTS

The present disclosure relates an apparatus and method of making a sign utilizing a kit of templates and spacers. More particularly, the present disclosure relates to an apparatus and method of making a sign utilizing a router with a kit that includes a plurality of templates that allow for connected script lettering, as well as routing of complementary numbers and symbols. By way of example, the routed letters, numbers or symbols are formed by positioning the templates on a workpiece that is typically a piece of wood. However, other materials can also be used. A router bit is guided within a groove of the template, which acts as a stencil, to form the letter, number, symbol, or portion thereof. While this description refers in exemplary embodiments to use of a router with an exemplary kit, it is to be understood that the described templates can also be used with other tools for marking or stenciling without a router. For example, a tool such as a brush could be used to apply paint, embossing powder, ink, or another substance in a groove 90 of a template to create a sign without a router. A workpiece could be a canvas, paper, poster, banner, window, wall or other surface capable of serving as a sign.

A known sign making apparatus and method is described in U.S. Pat. No. 9,802,333 to Krohmer et al. (hereinafter the '333 patent), which is hereby incorporated by reference. Referring to FIG. 3 of the '333 patent, the kit includes spacers for applying kerning to selected sequences of letters to provide an aesthetically pleasing result of the routed letters in a word or phrase when certain combinations of letters are adjacent to each other. Each of the letters or characters is provided in block form with spacing therebetween.

In contrast, in the currently described apparatus and method, templates and spacers are provided that allow for the routing of mutually connected letters, as in a typeface that resembles cursive handwriting. As with hand-written script lettering, not all of the letters of a phrase will be connected to an adjacent letter. However, such mutual connection is most common in the use lowercase letters.

FIG. 1 shows the capital letters of an exemplary typeface producible by routing using the templates in an embodiment of a currently described kit. FIG. 2 shows exemplary lowercase letter formation with the described kit. In FIG. 2, a space is shown between adjacent letters so that the full configuration of each letter is visible. However, as discussed in this description, an overlap of adjacent letters is used in routing a sequence of lowercase letters to form smoothly connected script wording. FIG. 3 shows numerals and symbols of the typeface (which typically are not connected to adjacent characters, even in a cursive writing presentation format).

Figure 4B:
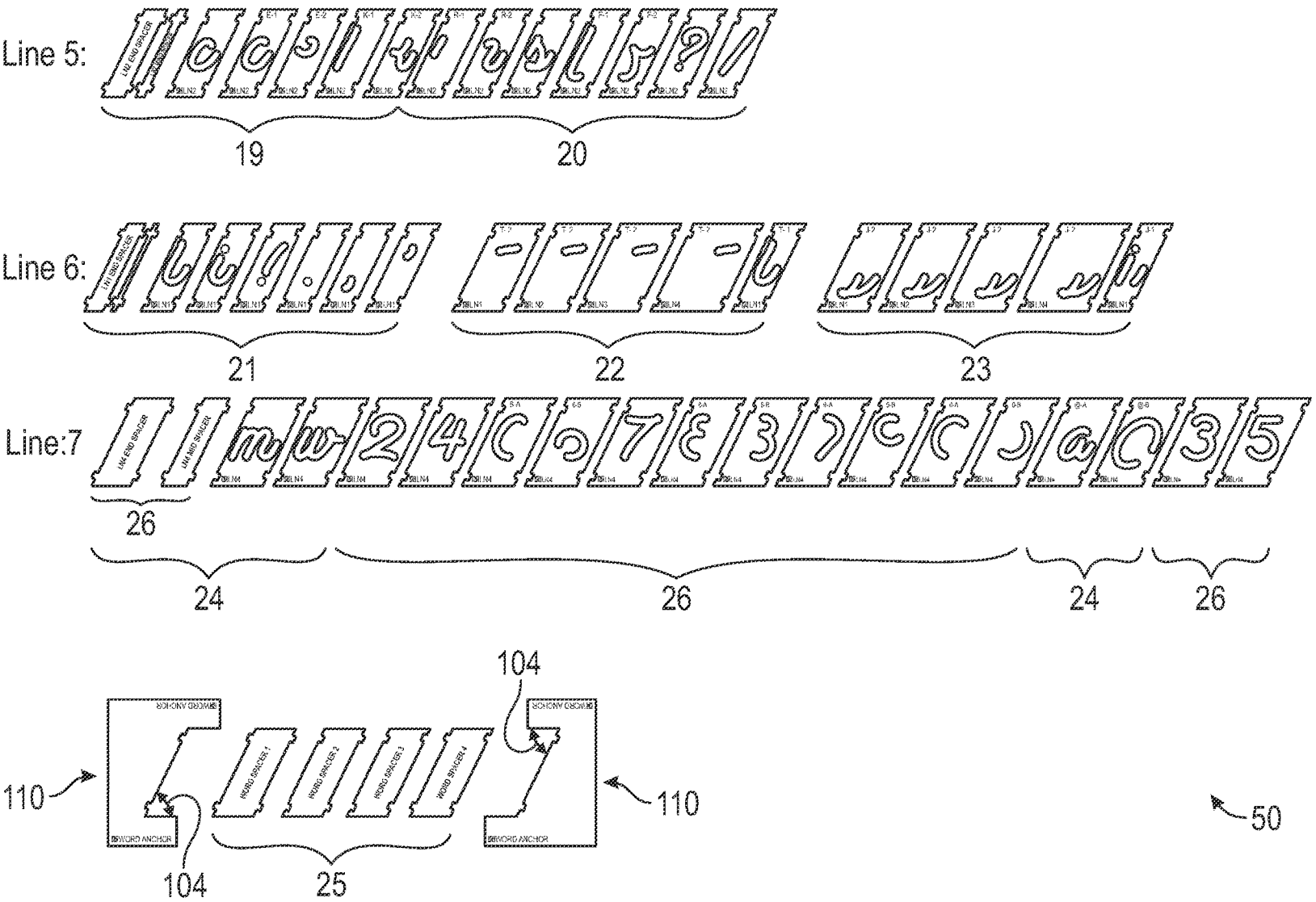

FIGS. 4A-4B show plan view of a kit 50, showing a plurality of routing plates, including spacers, templates and anchors. While this description refers to kit 50, it is to be understood that a kit may not include all the parts shown and may include additional elements that are not shown in FIGS. 4A-4B. For example, a kit may include only a subset of the elements shown in FIGS. 4A-4B, such as a number routing kit including only the spacers and templates shown in FIG. 26. Moreover, a kit may include additional templates, spacers or anchors, including for characters not illustrated, such as for foreign language letters, mathematical symbols, Greek symbols, and accent marks, for example. Additionally, a kit may include auxiliary accessories such as the bushing shown in FIG. 27. Moreover, a kit may include multiples of any spacers, templates, or anchors, such as those for commonly used characters, such as vowel letters, for example. Some exemplary numbers of suitable multiples are shown in the more detailed drawings of FIGS. 8-26 with the designations "x [integer]," for example.

As shown in FIGS. 4A-4B, the routing plates are arranged so that the templates of each Line have some common attributes. For example, each of the capital letter templates 52 of Line 1 has a common width $W_1$, as shown in FIGS. 8-11. The templates 52 of the capital letters of Line 1 having this common width $W_1$ include templates 52 for the letters Y, L, V, F, C, G, J, O, X, Z, Q, H, I, K, N and T. A Line 1 end spacer 54 suitable for use in place of a template 52 at an end (front end or back end) of a routed word has a width $W_{E1}$ that is less than the width $W_1$ of each of the Line 1 templates 52. In this disclosure, the width of a template or spacer is measured as the shortest distance between left edge 92 and right edge 94 (i.e., a width orthogonal to the parallel left and right edges 92, 94).

Figure 12:
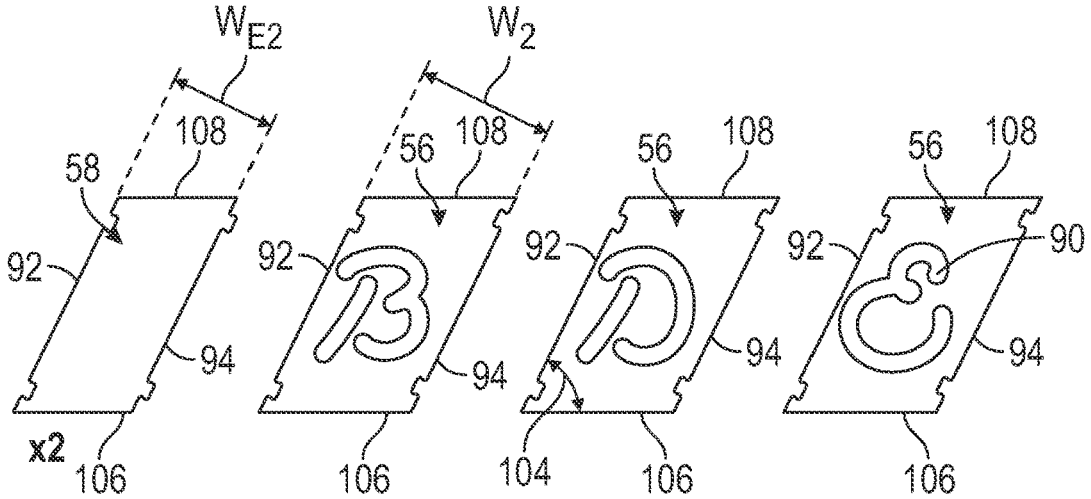
FIG. 12 is an enlarged plan view of the spacer and templates of FIG. 4A designated with the bracketed portion "12."
Figure 13:
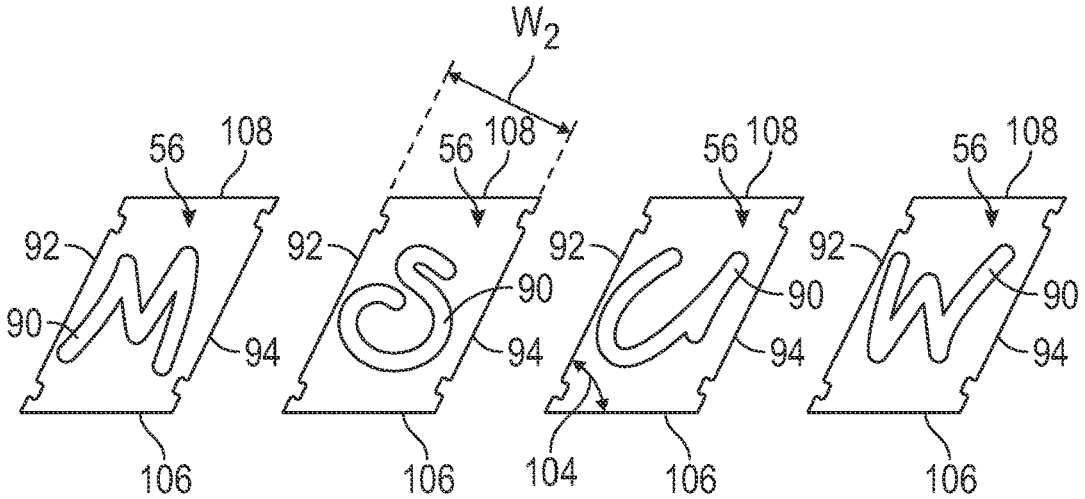
FIG. 13 is an enlarged plan view of the templates of FIG. 4A designated with the bracketed portion "13."

In an exemplary embodiment, each of the capital letter templates 56 of Line 2 has a common width $W_2$, as shown in FIGS. 12 and 13. The templates 56 of the capital letters of Line 2 having this common width $W_2$ include templates 56 for the letters B, D, E, M S, U and W. A Line 2 end spacer 58 suitable for use in place of a template 56 at an end (front end or back end) of a routed word has a width $W_{E2}$ that is less than the width $W_2$ of each of the Line 2 templates 56. In an exemplary embodiment, $W_2$ is greater than $W_1$ and $W_{E2}$ is greater than WEI.

Figure 14:
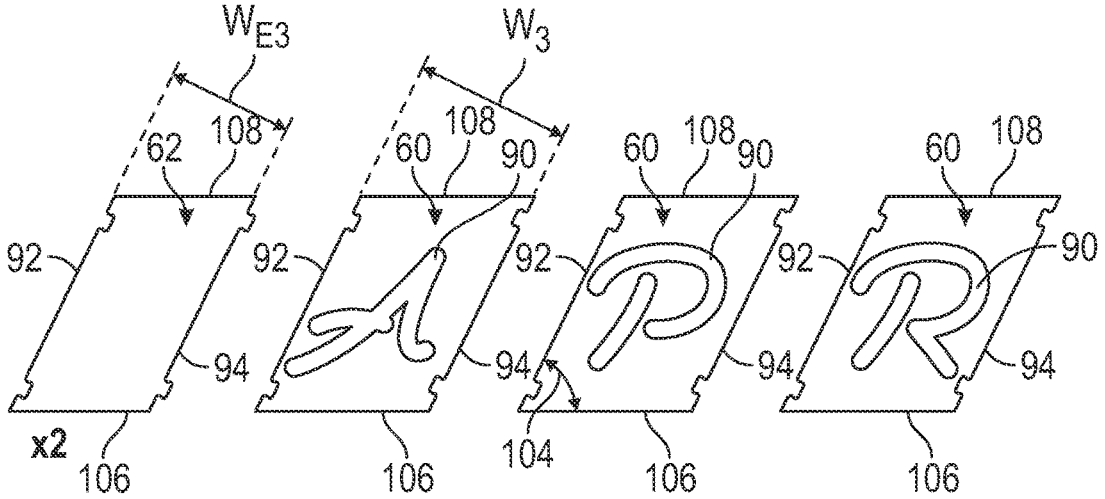
FIG. 14 is an enlarged plan view of the spacer and templates of FIG. 4A designated with the bracketed portion "14."
Figure 15:
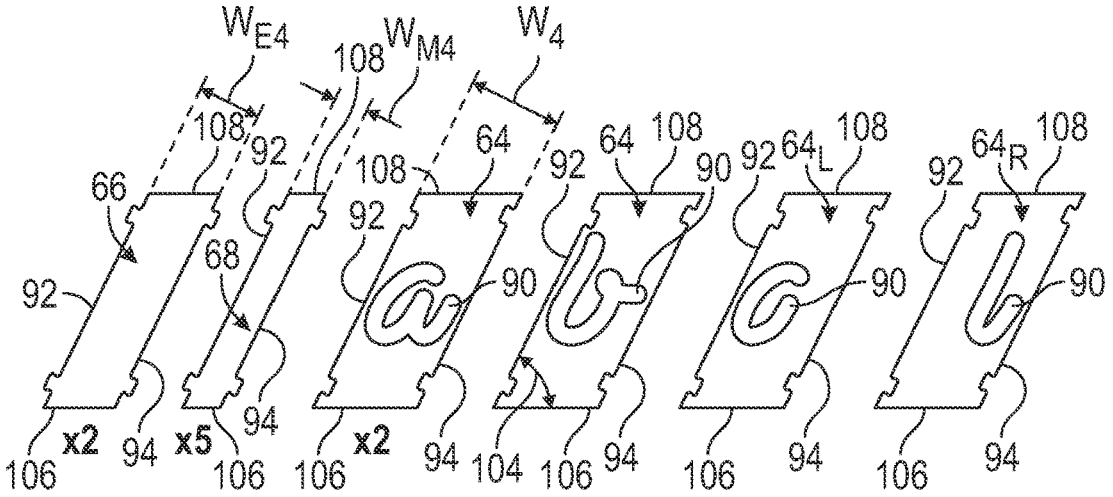
FIG. 15 is an enlarged plan view of the spacers and templates of FIG. 4A designated with the bracketed portion "15."
Figure 16:
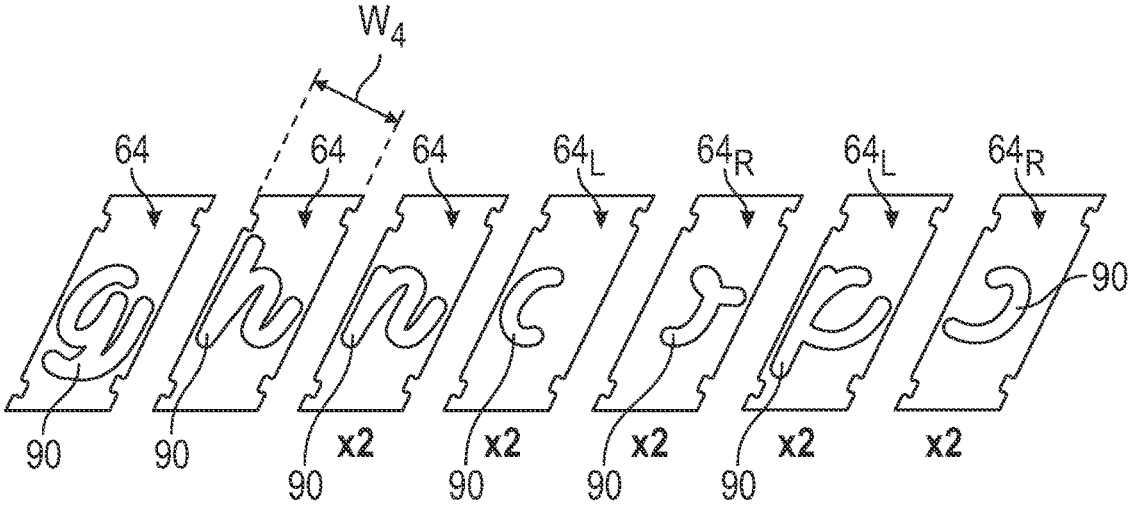
FIG. 16 is an enlarged plan view of the templates of FIG. 4A designated with the bracketed portion "16."
Figure 17:
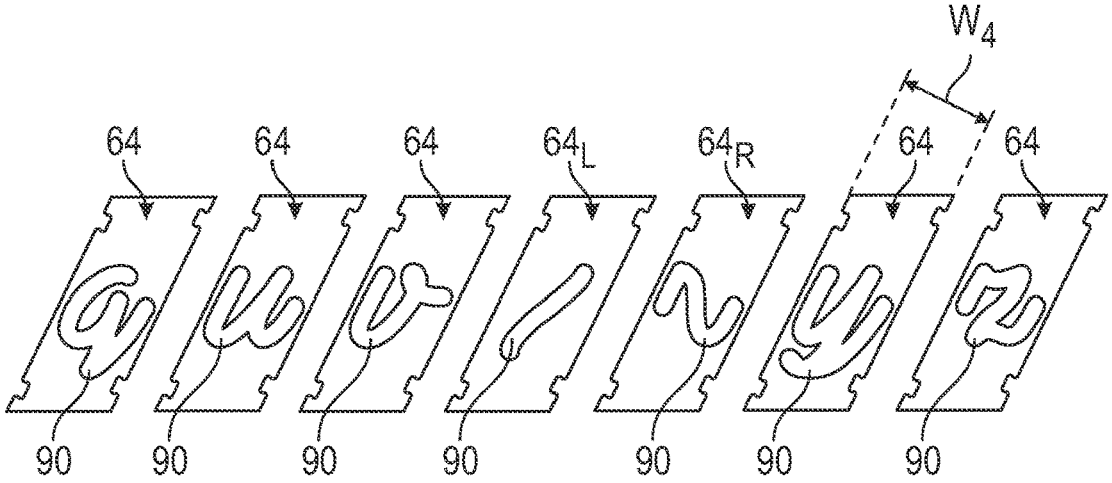
FIG. 17 is an enlarged plan view of the templates of FIG. 4A designated with the bracketed portion "17."
Figure 18:
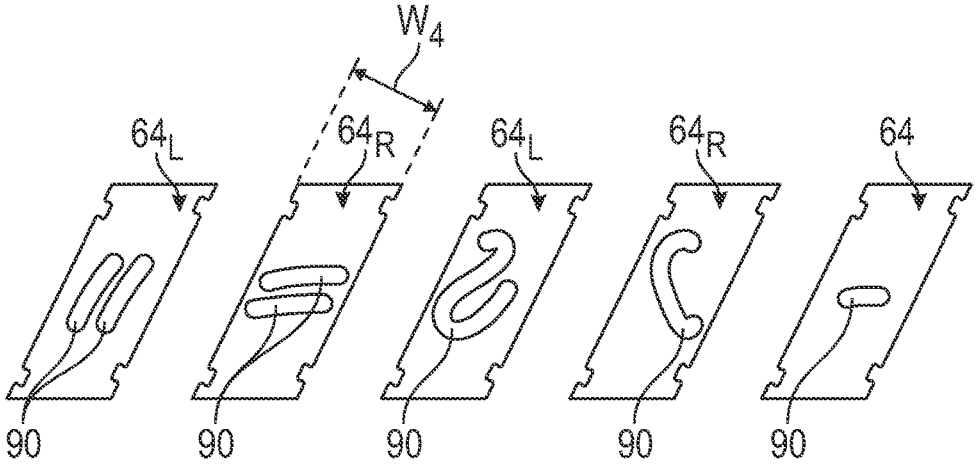
FIG. 18 is an enlarged plan view of the templates of FIG. 4A designated with the bracketed portion "18."
Figure 19:
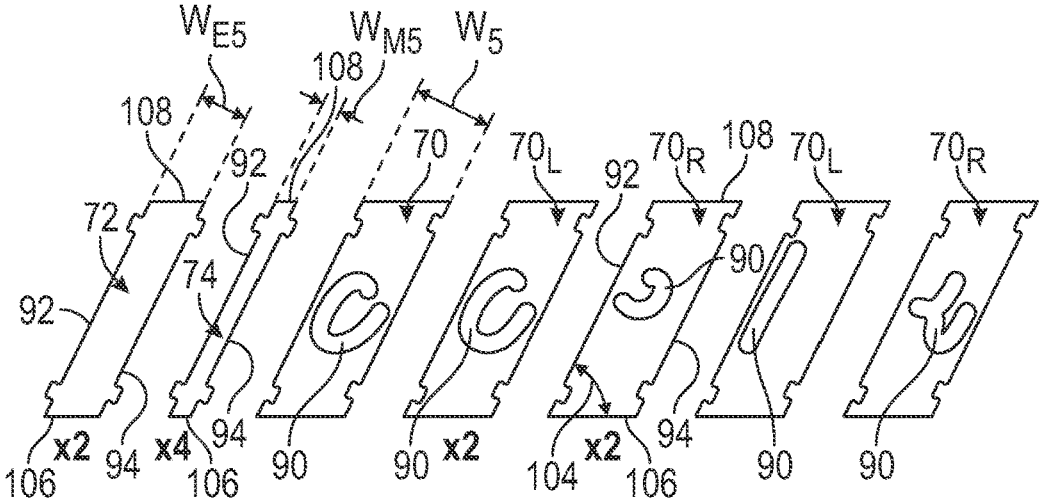
FIG. 19 is an enlarged plan view of the spacers and templates of FIG. 4B designated with the bracketed portion "19."
Figure 20:
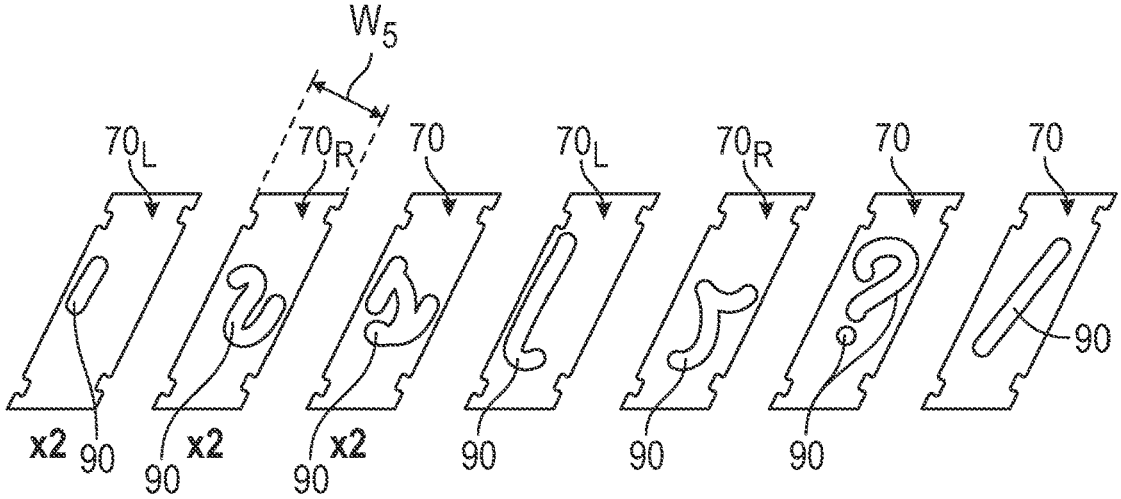
FIG. 20 is an enlarged plan view of the templates of FIG. 4B designated with the bracketed portion "20."

In an exemplary embodiment, each of the capital letter templates 60 of Line 3 has a common width $W_3$, as shown in FIG. 14. The templates 60 of the capital letters of Line 3 having this common width $W_3$ include templates 60 for the letters A, P and R. A Line 3 end spacer 62 suitable for use in place of a template 60 at an end (front end or back end) of a routed word has a width $W_{E3}$ that is less than the width $W_3$ of each of the Line 3 templates 60. In an exemplary embodiment, $W_3$ is greater than $W_2$ and $W_{E3}$ is greater than $W_{E2}$.

In an exemplary embodiment, each of the symbol, number and lowercase letter templates 64 of Line 4 has a common width $W_4$, as shown in FIGS. 15-18 and 26. The templates 64 of Line 4 having this common width $W_4$ include templates 64 for the lowercase letters a, b, d, g, h, n, o, p, q, u, v, x y and z; symbols $, #, & and –; and number 1. A Line 4 end spacer 66 suitable for use in place of a template 64 and at either end of a routed word has a width $W_{E4}$ that is less than the width $W_4$ of each of the Line 4 templates 64. In an exemplary embodiment, $W_4$ is less than $W_1$ and $W_{E4}$ is less than $W_{E1}$. A Line 4 middle spacer 68 suitable for use in place of a template 64 and in the middle of a routed word has a width $W_{M4}$ that is less than the width $W_{E4}$ of the Line 4 end spacer 66.

While this description refers to end spacers for use at either end of a word and middle spacers for use in the middle of a word, it is to be understood that a "word" need not be a recognizable word in the English language. It could also be an abbreviation, as in the term "Mt." in FIGS. 6A-6E. It could moreover be a group of numbers, such as the number "2395" in FIGS. 7A-7E. In short, a "word" can be any grouped templates and spacers, particularly those having unrouted space before and after the group. By "middle of a routed word," this description means that the template 64 is not at the beginning or end of the word; it can be anywhere other than the beginning or end positions, but need not be in the center of the word. A "phrase" need not be an understandable phrase in the English language and instead refers to a series or grouping of templates and spacers arranged to route corresponding characters into a workpiece and/or the routed result. Most phrases in the English language will be positioned to read horizontally from left to right on a workpiece.

Figure 21:
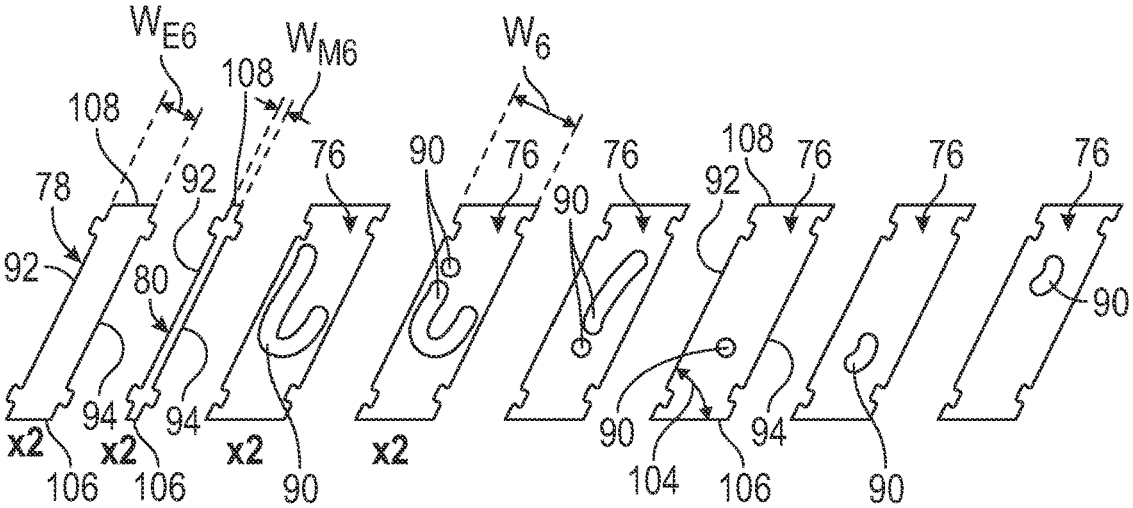
FIG. 21 is an enlarged plan view of the spacers and templates of FIG. 4B designated with the bracketed portion "21."

In an exemplary embodiment, each of the symbol and lowercase letter templates 76 of Line 6 has a common width $W_6$, as shown in FIG. 21. The templates 76 of Line 6 having this common width $W_6$ include templates 76 for the lowercase letters l and i and symbols !., and '. A Line 6 end spacer 78 suitable for use in place of a template 76 and at either end of a routed word has a width $W_{E6}$ that is less than the width $W_6$ of each of the Line 6 templates 76. In an exemplary embodiment, $W_6$ is less than $W_5$ and $W_{E6}$ is less than $W_{E5}$. A Line 6 middle spacer 80 suitable for use in place of a template 76 and in the middle of a routed word has a width $W_{M6}$ that is less than the width $W_{E6}$ of the Line 6 end spacer 78. In an exemplary embodiment, $W_{M6}$ is less than $W_{M5}$.

Figure 22:
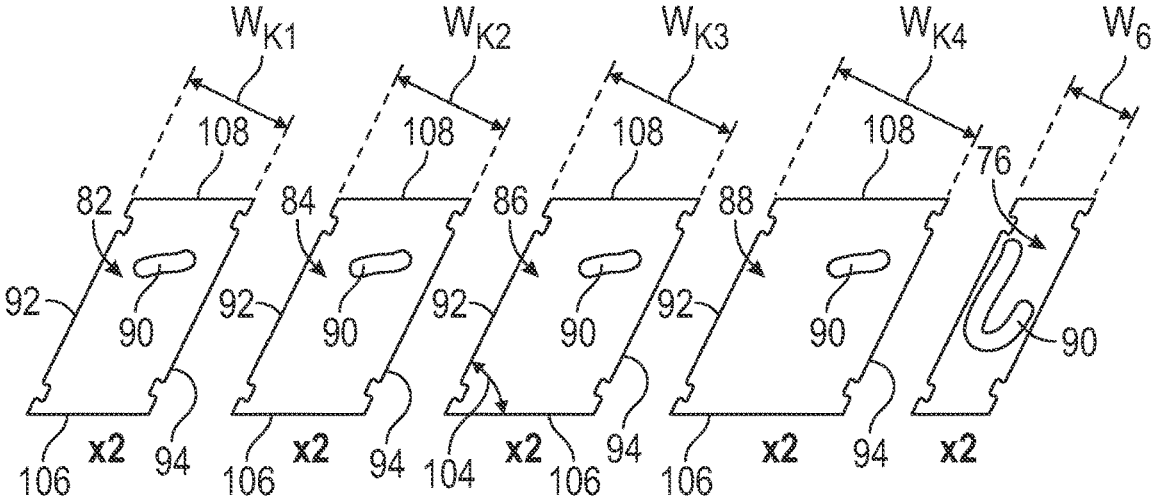
FIG. 22 is an enlarged plan view of the templates of FIG. 4B designated with the bracketed portion "22."

FIG. 22 illustrates a special template set for the lowercase letter "t." Template 76 having width $W_6$ is used for routing of the vertical stem for the "t." One of either first kerning template 82, second kerning template 84, third kerning template 86 or fourth kerning template 88 is used to route the horizontal cross bar of the "t," depending on desired spacing between the "t" and the preceding character. In an exemplary embodiment, the routing groove 90 is positioned at a common distance from the right edge 94 of each of the kerning templates 82, 84, 86 and 88. However, the distance of the routing groove 90 from the left edge 92 is different. Width $W_{K1}$ of the first kerning template 82 is less than width $W_{K2}$ of the second kerning template 84. Width $W_{K2}$ of the second kerning template 84 is less than width $W_{K3}$ of the third kerning template 86. Width $W_{K3}$ of the third kerning template 86 is less than width $W_{K4}$ of the fourth kerning template 88.

Figure 23:
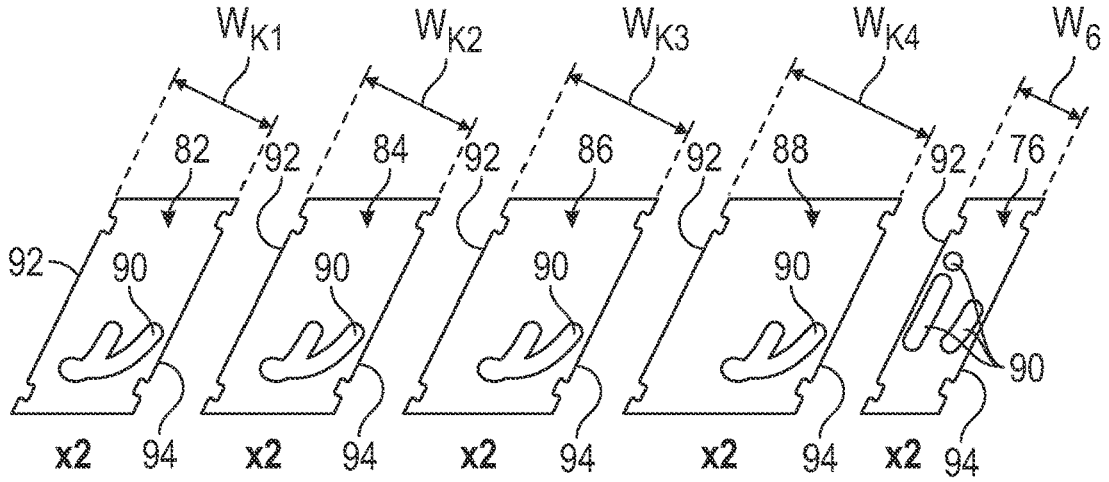
FIG. 23 is an enlarged plan view of the templates of FIG. 4B designated with the bracketed portion "23."

FIG. 23 illustrates a special template set for the lowercase letter "j." Template 76 having width $W_6$ is used for routing of the upper portions for the script "j." One of either first kerning template 82, second kerning template 84, third kerning template 86 or fourth kerning template 88 is used to route the lower portion of the "j," depending on desired spacing between the "j" and the preceding character. In an exemplary embodiment, the routing groove 90 is positioned at a common distance from the right edge 94 of each of the kerning templates 82, 84, 86 and 88. However, the distance of the routing groove 90 from the left edge 92 is different. Width $W_{K1}$ of the first kerning template 82 is less than width $W_{K2}$ of the second kerning template 84. Width $W_{K2}$ of the second kerning template 84 is less than width $W_{K3}$ of the third kerning template 86. Width $W_{K3}$ of the third kerning template 86 is less than width $W_{K4}$ of the fourth kerning template 88.

Figure 24:
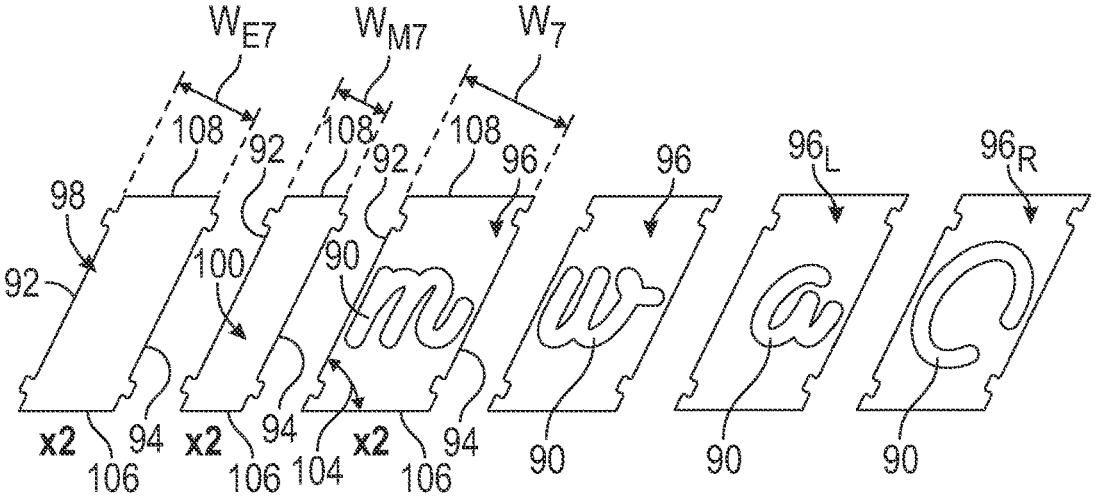
FIG. 24 is an enlarged plan view of the spacers and templates of FIG. 4B designated with the bracketed portion "24."
Figure 26:
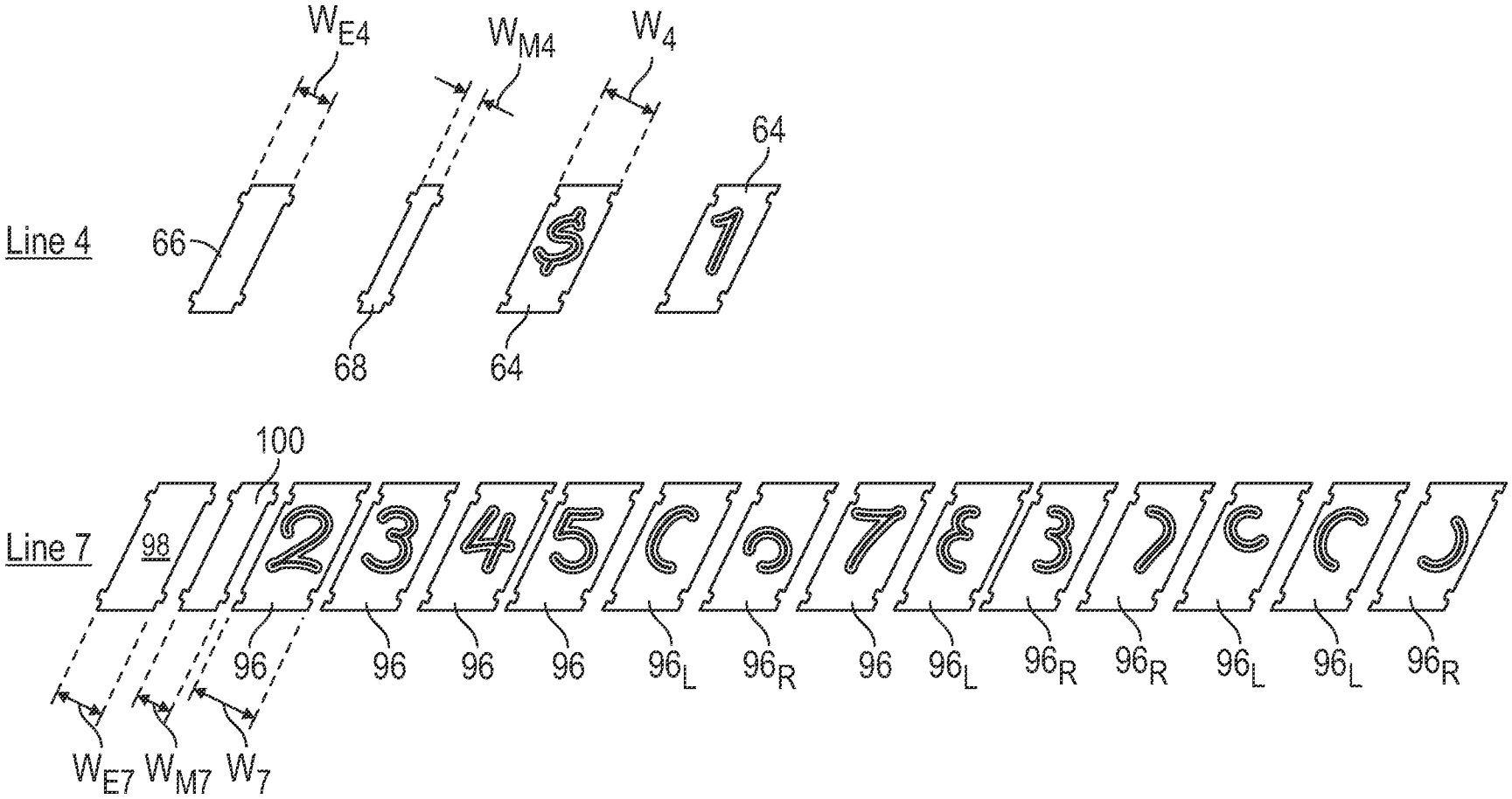
FIG. 26 is an enlarged plan view of the spacers and templates of FIGS. 4A-4B designated with the bracketed portions "26" and used for routing the symbol "$" and numbers.

In an exemplary embodiment, each of the symbol, number and lowercase letter templates 96 of Line 7 has a common width $W_7$, as shown in FIGS. 24 and 26. The templates 96 of Line 7 having this common width $W_7$ include templates 96 for the lowercase letters m and w; symbol @; and numerals 2, 3, 4, 5, 6, 7, 8, 9 and 0. A Line 7 end spacer 98 suitable for use in place of a template 96 and at either end of a routed word has a width $W_{E7}$ that is less than the width $W_7$ of each of the Line 7 templates 96. A Line 7 middle spacer 100 suitable for use in place of a template 96 and in the middle of a routed word has a width $W_{M7}$ that is less than the width $W_{E7}$ of the Line 7 end spacer 98. In an exemplary embodiment, $W_7$ is greater than $W_4$ and less than $W_1$; $W_{E7}$ is greater than $W_{E4}$ and less than $W_{E1}$; $W_{M7}$ is greater than $W_{M4}$ and less than $W_{M1}$.

Figure 25:
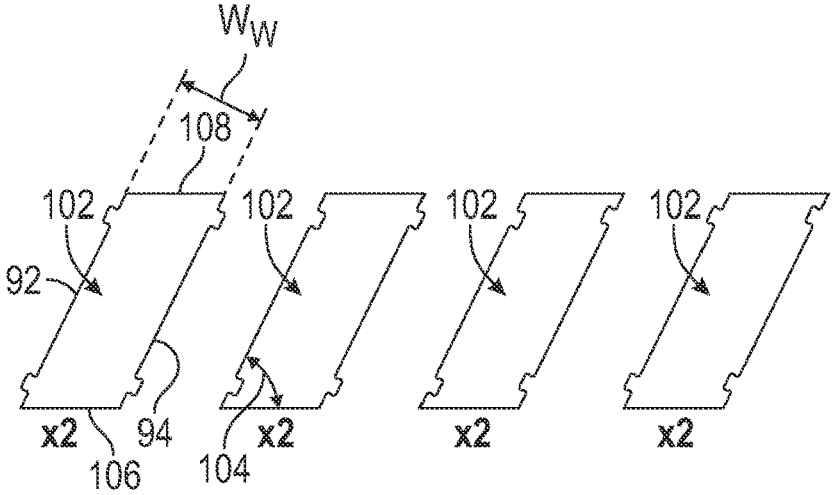
FIG. 25 is an enlarged plan view of the spacers of FIG. 4B designated with the bracketed portion "25."

FIG. 25 shows four identical word spacers 102, though more or fewer may be provided in kit 50. Spacer 102 has a width $W_W$ that is greater than $W_{E7}$ and less than $W_{E1}$. In kit 50, each of the templates and spacers has a slanted configuration defined by mutually parallel left edge 92 and right edge 94, both of which are inclined at an angle 104 relative to a bottom edge 106 that is aligned with the direction of the lettering (in English, the direction of lettering is typically horizontal, from left to right). In an exemplary embodiment, top edge 108 is parallel to bottom edge 106. In an exemplary embodiment, angle 104 is about 64 degrees but can be any acute angle. The slant of each of the templates and spacers, provided by inclining the left edge 92 and the right edge 94 of the template or spacer by acute angle 104, allows the produced letters to mimic the tilt or slant of handwritten cursive script.

An exemplary kit 50 includes at least two word anchors 110 to maintain templates of a desired phrase in position, even as templates spacers are interchanged between routing passes. For example, FIGS. 5A-5E demonstrate the use of word anchors 110 at both ends of templates and spacers used to route a phrase. While the word anchors are not shown in FIGS. 6A-7E, it is to be understood that they could be used for routing the desired phrases, even though they are not shown in the illustrations. In an exemplary embodiment, all of the word anchors 110 are identical; depending on whether an anchor 110 is used at the beginning or end of a phrase, it is either used with a longer horizontal leg on top, as shown on the left side of FIGS. 5A-5D, or rotated 180 degrees so that the longer horizontal leg is on the bottom, as shown on the right side of FIGS. 5A-5E.

In exemplary embodiments, each word anchor 110 has the same thickness as each of the routing templates or spacers, and is configured to fit around one edge 92 or 94 of a template or spacer, as well as at least partially along bottom edge 106 and top edge 108 of the template or spacer. In an exemplary embodiment of kit 50, each word anchor, template and spacer has a common thickness between a front surface that faces a user and a back surface that rests on the workpiece. This allows for consistency in the depth of routing in the grooves 90.

FIGS. 5A-5F show sequential steps for the placement of word anchors 110 and various templates and spacers for routing the phrase 112 "Try It Out" in an exemplary method of using the kit 50. Because of the complexity and number of template and spacer elements, in an exemplary method of use, a software program that may be referred to as a "wizard" can be used to assist a woodworker in positioning the correct templates and spacers for routing any desired phrase. A user can simply input (such as by typing into a computer keyboard) the desired phrase with the desired capitalization or lowercase letters into the software wizard, and it will return an output similar to FIGS. 5A-5F, to guide the user in the selection and placement of the word anchors, templates and spacers for each routing pass, between word anchors 110. Each drawing figure shows the characters to be routed into a work piece through the groove 90 of each template in a single pass of the routing tool over the templates and workpiece. After the completion of routing in all of the presented grooves of the templates of a pass, the user replaces certain spacers and templates as illustrated in the next drawing figure for routing in the next pass of the routing tool over the templates and workpiece.

Figure 5A:
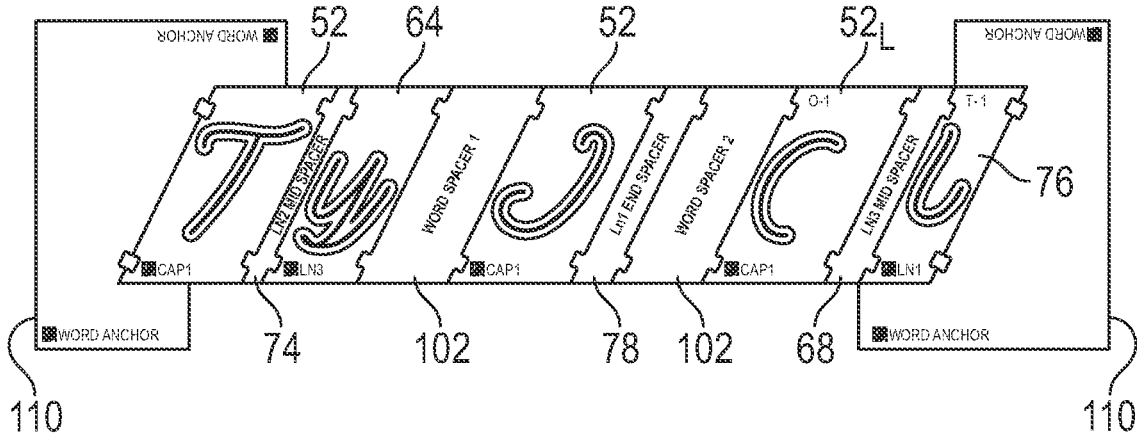
FIGS. 5A-5F show five sequential steps for the placement of anchors, spacers, and templates of the kit of FIGS. 4A-4B for routing the phrase "Try It Out."

For example, FIG. 5A illustrates the placement of a word anchor 110 on one side of the desired phrase to be routed into a workpiece. The user then, in sequence, positions Line 1 template 52 for the capital letter "T" and Line 5 middle spacer 74 in place of a lowercase "r" that will eventually be routed with the Line 5 templates 70. In an exemplary embodiment of kit 50, the left and right edges 92, 94 of each routing template include dovetail recesses, and the left and right edges 92, 94 of each spacer include dovetail protrusions configured to fit securely in the recesses. Accordingly, each of the spacers and templates fits securely to an adjacent template or spacer, so that the routed characters remain in their desired positions throughout the various passes of the routing tool over the templates and workpiece. Next to the Line 5 middle spacer 74, the user positions Line 4 template 64 for the lowercase letter "y."

Next, the user positions word spacer 102, to provide proper spacing between the words "Try" and "It." Next, the user places Line 1 template 52 for the capital letter "I." The user then places Line 6 end spacer 78 to hold the place for a lowercase "t" that will be routed later. Next, the user places word spacer 102 to provide for proper spacing between the words "It" and "Out." The user places template $\mathbf{52}_L$ for the left side of the capital letter "O." The user then places Line 4 middle spacer 68 to preserve the spacing for a lowercase "u" to be later routed in the middle of the word "Out." The user then places Line 6 template 76 to route the vertical stem of the lowercase letter "t." Finally, the user places a word anchor 110, oriented to fit the right end of phrase 112. After all the templates and spacers are arranged as shown in FIG. 5A by the software wizard program, the user can push together on the ends of word anchors 110 to ensure that all of the anchor, template and spacer plates are securely attached to each other. Thus, they are positioned to allow for routing in grooves 90 in a first routing pass of the routing tool over the templates and workpiece as disposed in FIG. 5A. The entire row of templates, spacers and anchors can be secured to the workpiece by painter's tape, for example.

It can be seen that the middle spacers are narrower than the letters for which they are preserving a space, so that in a finished routed phrase, the letters are connected to each other. For example, as can be seen in a comparison of FIGS. 5B and 5C, the spacer 74 that preserves space for routing of the lowercase letter "r" is much narrower than the template 70 for routing the letter itself. Because the letters "r" and "y" will be connected to each other in the finished routed word "Try," it can also be seen that the template 64 for the lowercase letter "y" must be removed and replaced with the Line 3 end spacer 66, which is narrower than the template 64, to allow space for routing of the entire lowercase letter "r" with the templates $\mathbf{70}_L$, $\mathbf{70}_R$. Similar considerations are made for the routing of any lowercase letter in the middle of a word.

Figure 5B:
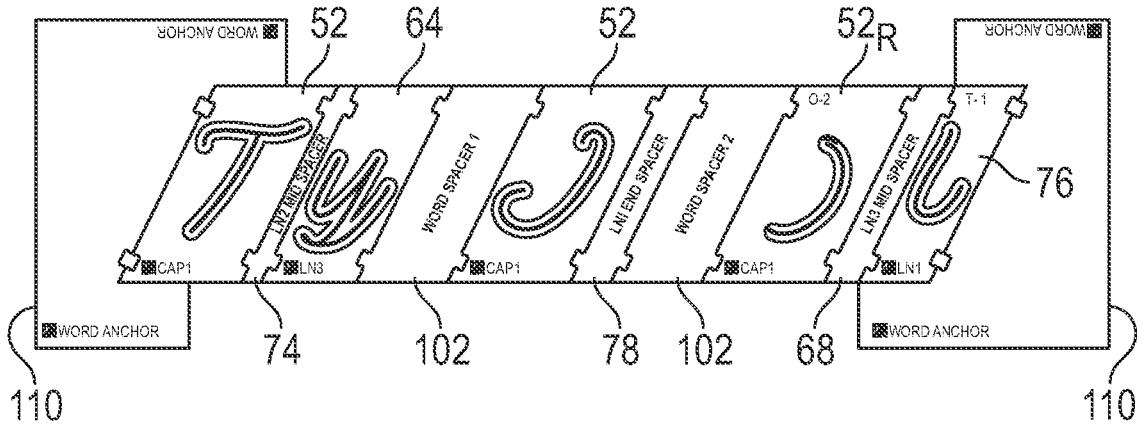

The present disclosure includes a kit having an interlocking template system having a plurality of templates including multiple templates that are used to form a single letter, number or symbol having an island with an uninterrupted perimeter. With the disclosed kit, a sequence of templates are utilized to form some letters, numbers and symbols with and without islands. For instance, as illustrated in FIGS. 5A, 5B and 5F, the letter "O" has an island and is routed into a workpiece by using different templates $\mathbf{52}_L$ and $\mathbf{52}_R$ in sequence. The resulting routed letter "O" has a continuous, smooth outline around the island, thereby producing a pleasing appearance. Additionally, in an exemplary embodiment, multiple templates are provided for a portion of some letters, wherein the choice of template to be used depends on spacing of the letter relative to adjacent letters (for example, a horizontal cross of a "t" or a hanging tail of a "j").

After placing the anchors, templates and spacers as shown in FIG. 5A, a user can use a router to engrave a workpiece within each of the grooves 90 of the templates in a first pass of the routing tool over the templates and workpiece.

As shown in FIG. 5B, before a second pass of the routing tool over the templates and workpiece, the user replaces template $\mathbf{52}_L$ for the left side of the capital letter "O" with the same dimension template $\mathbf{52}_R$ for the right side of the capital letter "O." In the second pass, the only groove 90 that is routed is that in template $\mathbf{52}_R$.

Figure 5C:
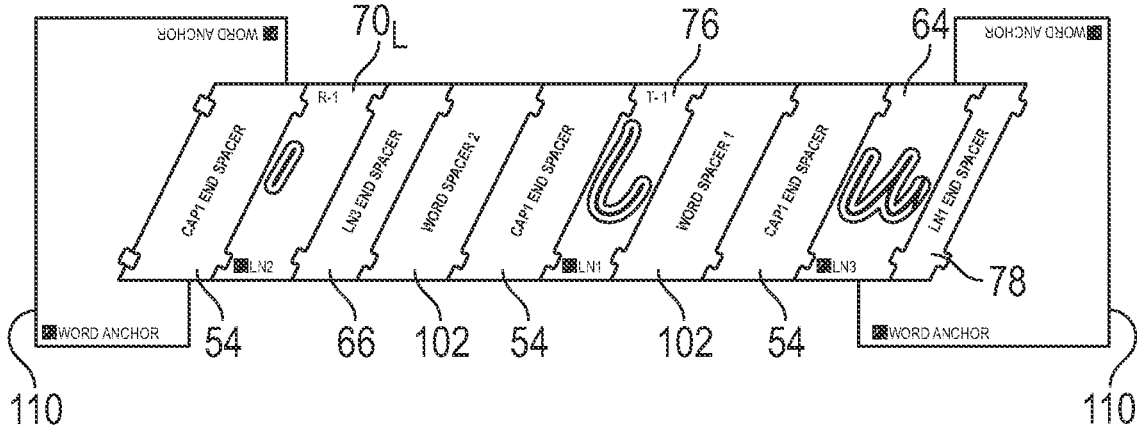

Before a third pass of the routing tool over the templates and workpiece, as shown in FIG. 5C, a user makes space for routing of the lowercase letter "r" by replacing templates 52 for the capital letter "T" with a narrower Line 1 end spacer 54. The user likewise replaces template 64 for the letter "y" with a narrower Line 4 end spacer 66. The user then has space between the left word anchor 110 and the word spacer 102, which remain in their original positions, to place a first Line 5 template $70_L$ for a left portion of the letter "r." After the word spacer 102, the template 52 for the capital letter "I" is replaced with a narrower Line 1 end spacer 54 to make room for routing of a stem portion of the lowercase letter "t" with Line 6 template 76.

The second word spacer 102 between the words "It" and "Out" remains in its original position. Template $52_R$ for the capital letter "O" is replaced with Line 1 end spacer 54, which is narrower than template 52, to provide room for template 64 for the lowercase letter "u," next to a narrower Line 6 end spacer 78, which replaces template 76 for the vertical stem of the lowercase letter "t." The user then routes within the grooves 90 of the templates $70_L$, 76 and 64.

Figure 5D:
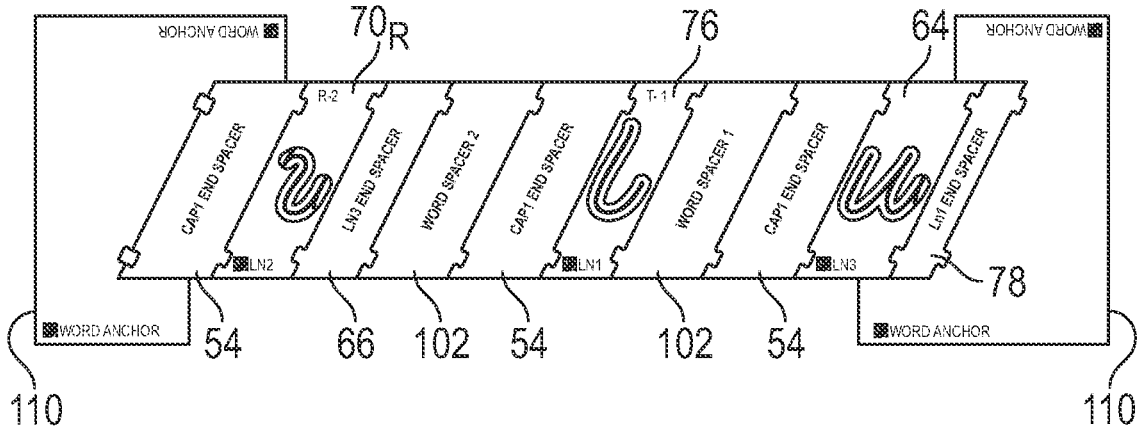

Before the next (fourth) pass of the routing tool over the templates and workpiece, as shown in FIG. 5D, the user replaces template 70 for the left portion of the lowercase letter "r" with a template $70_R$ for a right portion of the lowercase letter "r." On the fourth pass, only the groove 90 of the template $70_R$ is routed. While this script letter does not have an island, a very small space is provided between these portions of the letter, and using separate templates allows each of the templates to have enough material around the groove 90 to preserve its structural integrity through many uses. At this point, the entire word "Try" has been routed, and the anchor, templates and spacers for that word can be removed if desired.

Figure 5E:
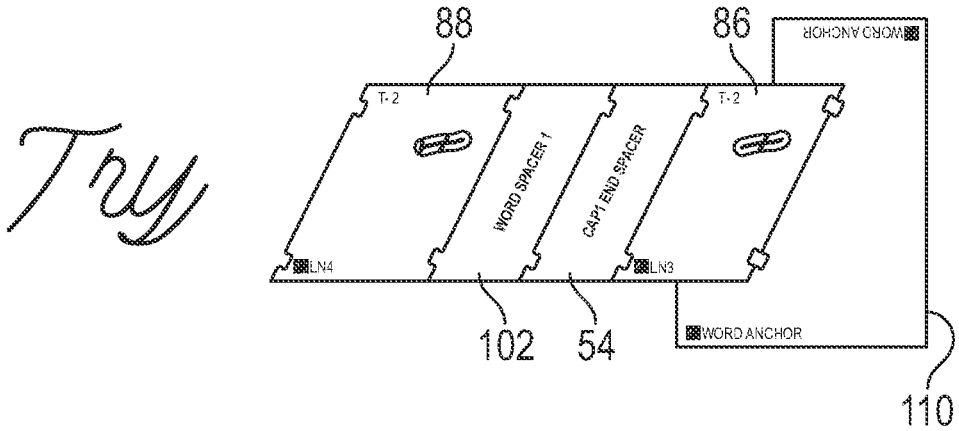
Figure 5F:
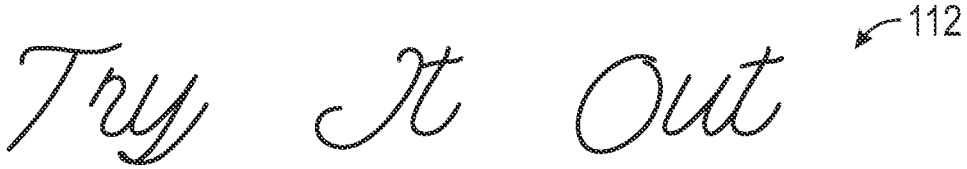

In the fifth pass, as shown in FIG. 5E, third and fourth kerning templates 86, 88 are provided for routing the horizontal cross of the lowercase letters "t." In the $5^{th}$ pass, only the grooves 90 of the two templates 86, 88 are routed. As more clearly shown in FIG. 22, the cross character grooves 90 of the two templates 86, 88 are identical; moreover, a distance of the groove 90 from the right edge 94 of the two templates 86, 88 is the same. However, the distances of the groove 90 from the left edge 92 of the templates 86, 88 are different because the overall widths $W_{K3}$ and $W_{K4}$ of the templates 86, 88 are different. The choice between the two kerning templates 86, 88 depends on the spacing before the groove, which takes into account the size and spacing of characters just before (to the left of) the kerning template.

As shown in FIG. 5A, for the capital letter O, a first template $52_L$ includes a first (left) portion of the letter O. As shown in FIG. 5B, once the first portion of the letter has been routed into the workpiece using the template $52_L$ to guide the router, the template $52_L$ is removed and a second template $52_R$, having the same dimensions in length and width (L and W) as the first template $52_L$, is located in the same location as the first template $52_L$. A second (right) portion of the letter O overlaps with the previously routed left portion of the letter O. Therefore, when the second template $52_R$ is utilized along with the router, the router bit can be positioned into the previously cut groove and a continuous perimeter is routed around the island of the letter O.

A similar two-pass system is utilized for characters such as those having islands, which include the capital letters O and Q of the exemplary script typeface; the lowercase letters d, e, f, o and p of the exemplary script typeface; the numbers 6, 8, 9 and 0 of the exemplary script typeface; the symbols @, # and & of the exemplary script typeface; and the non-island lowercase letters j, k, r, t and x of the exemplary script typeface. However the kit could be utilized to form other letters, numbers or symbols. The templates for each of the two-pass letters, numbers and symbols include two templates (sometimes denoted with a subscript "L" for "left" or "R" for "right") that are configured to have an overlap in the routed groove when positioned alternatively in the same location, such that the router bit can be placed in the preexisting routed groove formed utilizing the first template when forming the second portion of the letter, number or symbol.

While exemplary two-pass letters, numbers and/or symbols are listed above for the exemplary script typeface shown in FIGS. 1-3, it is contemplated that other connected script typefaces can be used, wherein other letters, numbers or symbols may have two or more templates. Such letters, numbers, or symbols may also be routed utilizing the same two step or sequential process using at least two templates to form a single letter, number or symbol. While a two-step sequential process is disclosed, it is contemplated that more than two templates, and thus more than two passes, may be utilized to form a letter, number or symbol. Additionally, this disclosure can be extended beyond typographical symbols to include other text and graphics, such as company logos, for example.

Figure 6A:
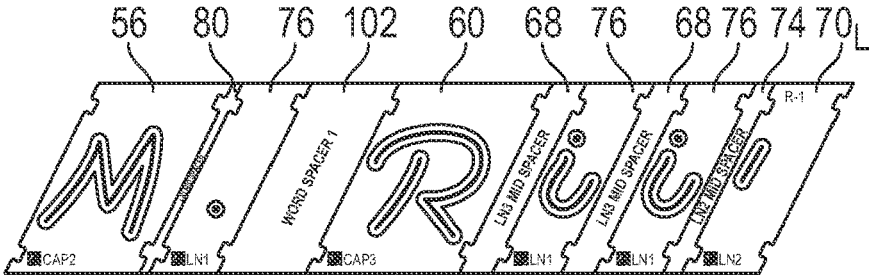
FIGS. 6A-6E show four sequential steps for the placement of spacers and templates of the kit of FIGS. 4A-4B for routing the phrase "Mt. Rainer."

FIGS. 6A-6E show four sequential steps for the placement of templates and spacers for routing the phrase 116 "Mt. Rainier" in a workpiece. While word anchors 110 are not shown on these drawings, it is to be understood that they can be used in a routing method. As shown in FIG. 6A, templates and spacers are arranged for the routing of at least portions of every other letter or character of the phrase 116. In the first pass of a routing tool over the templates and workpiece, a user routes in the grooves 90 of templates 56, 76, 60, 76, 76, and $70_L$ of FIG. 6A.

Figure 6B:
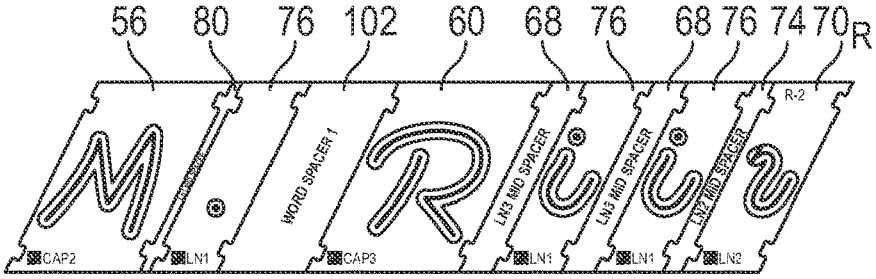

After routing of each of the grooves of the templates of FIG. 6A, a change is made in FIG. 6B by replacing the template $70_L$ for the left portion of the lowercase "r" with the template $70_R$ for the right portion of the lowercase letter "r." In the second pass of a routing tool over the templates and workpiece, only groove 90 of template $70_R$ is routed. It can be seen that the grooves of the templates $70_L$ and $70_R$ overlap, so that a finished routed lowercase script letter "r" appears continuous, as shown in FIG. 6E. After the routing pass in FIG. 6B is completed, the templates and spacers are interchanged so that each routing template is replaced by a spacer, and vice versa, except for the word spacer 102, which remains in its position.

Figure 6C:
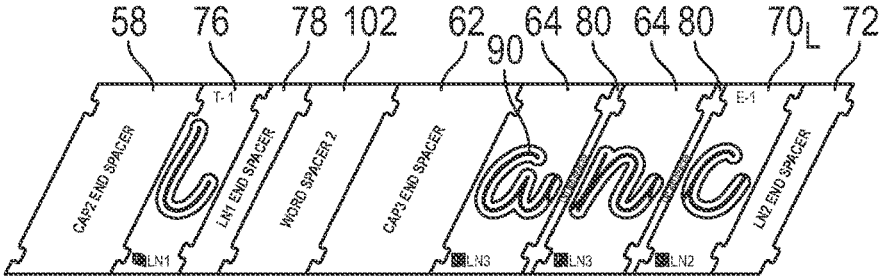

In a comparison of FIGS. 6B and 6C, it can be seen that each of the spacers replacing a character template is narrower than the character template it replaces. This allows for the letters routed to be positioned much closer to each other than would be possible with templates of uniform width. Moreover, as visible with templates 64 for the lowercase letters "a" and "n" and template $70_L$ for the left portion of the lowercase letter "e," this close spacing allows for connecting the grooves of lowercase letters in a script type face to emulate handwritten cursive script. For example, looking at template 64 for the lowercase letter "a," an overlap is visible within groove 90 of the routed forms of the lowercase letter "a" and the adjacent lowercase letter "i." Similar groove overlaps are visible for template 64 for the lowercase letter "n" and template $70_L$ for the lowercase letter "e" with their adjacent lowercase letters. In the third pass of a routing tool over the templates and workpiece, grooves 90 of templates 76, 64, 64, and $70_L$ of FIG. 6C are routed.

Figure 6D:
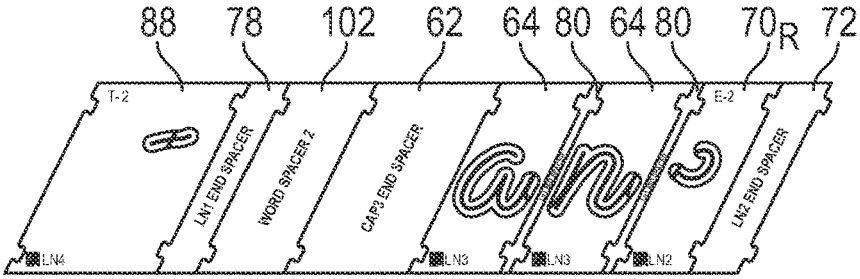
Figure 6E:
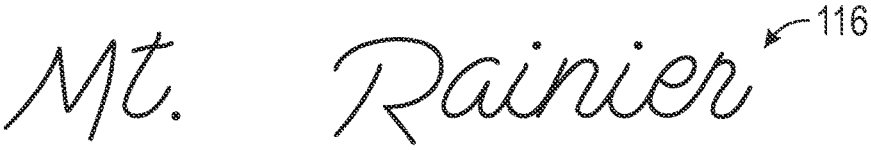

After routing is performed in each of the templates of FIG. 6C, template 76 for the stem of the lowercase letter "t" is replaced by template 88 for the cross of the lowercase letter "t." Template $70_L$ for the left portion of the lowercase letter "e" is replaced with template $70_R$ for the right portion of the lowercase letter "e." In the fourth pass of a routing tool over the templates and workpiece, grooves 90 of templates 88, 64, 64, and $70_R$ of FIG. 6D are routed. After routing these additional grooves, the user is finished with routing the phrase 116 shown in FIG. 6E.

Figure 7A:
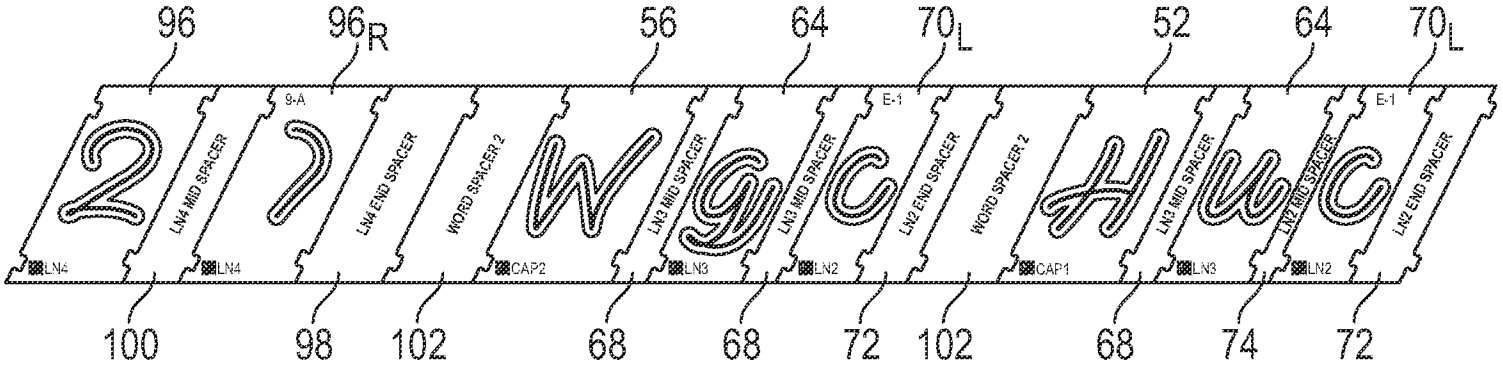
FIGS. 7A-7E show four sequential steps for the placement of spacers and templates of the kit of FIGS. 4A-4B for routing the phrase "2395 Wagner Houses."

FIGS. 7A-7E show four sequential steps for the placement of templates and spacers for routing the phrase 118 "2395 Wagner Houses." The use of word anchors 110 is not illustrated, but it is to be understood that they can be placed at the beginning and end of the sequence of templates and spacers. As shown in FIG. 7A, templates are placed for routing at least portions of every other character in the phrase 118. In the first pass of a routing tool over the templates and workpiece, a user routes in the grooves 90 of templates 96, $\mathbf{96}_R$, 56, 64, $\mathbf{70}_L$, 52, 64 and $\mathbf{70}_L$ of FIG. 7A. In several cases, such as with the numeral 9 and the lowercase letter "e," only a portion of the letter is completed by routing with the templates in FIG. 7A.

Figure 7B:
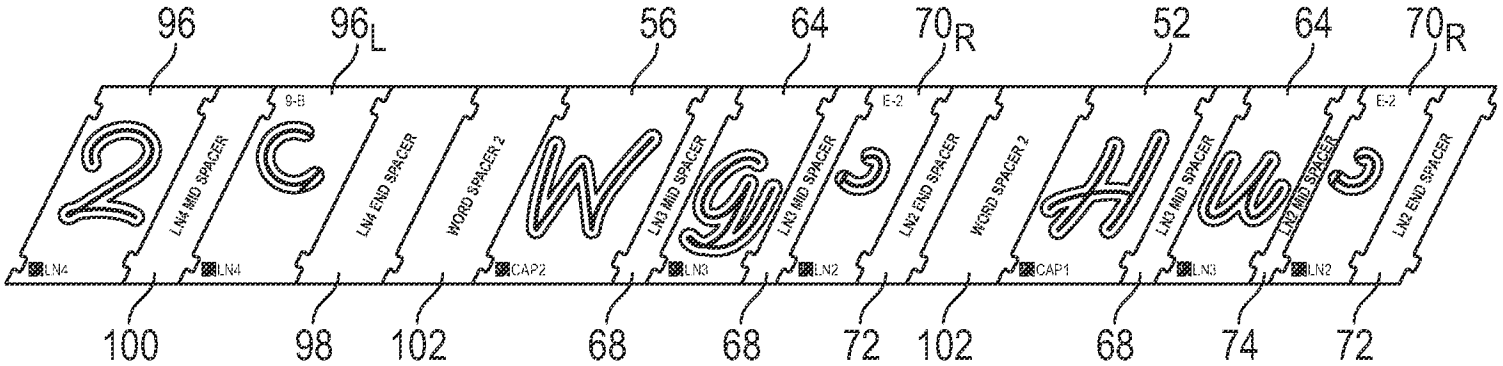

Thus, in FIG. 7B, these templates $\mathbf{96}_R$ and $\mathbf{70}_L$ are then replaced with cooperative templates $\mathbf{96}_L$ and $\mathbf{70}_R$, respectively, for routing the other portion of these characters. In the second pass of a routing tool over the templates and workpiece, a user routes in the grooves 90 of templates $\mathbf{96}_L$ and $\mathbf{70}_R$ of FIG. 7B.

Figure 7C:
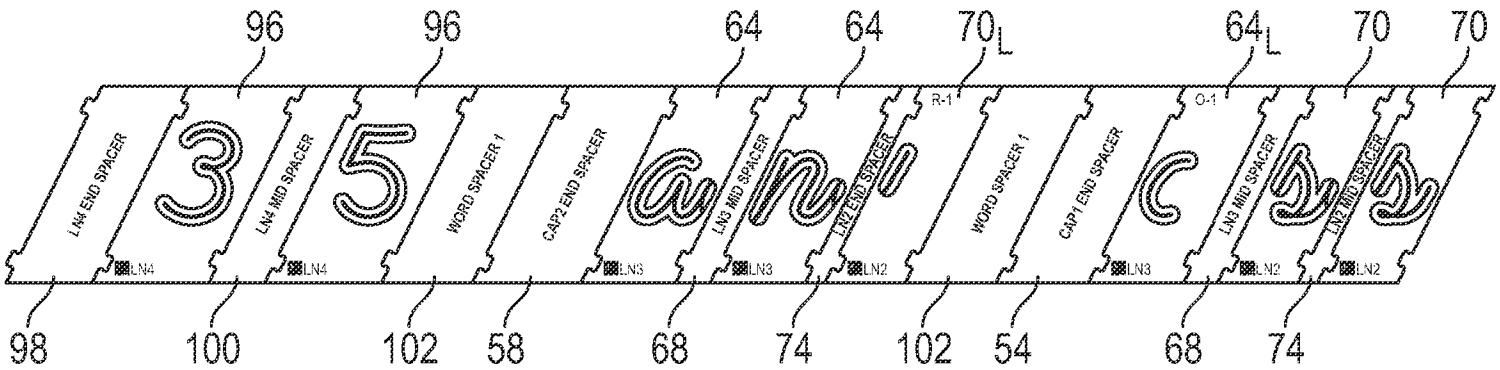

In FIG. 7C, each of the routing templates is replaced by a narrower spacer, and each of the spacers other than the word spacer 102 is replaced with a routing template for routing characters intermediate the previously routed characters. In the third pass of a routing tool over the templates and workpiece, a user routes in the grooves 90 of templates 96, 96, 64, 64, $\mathbf{70}_L$, $\mathbf{64}_L$, 70 and 70 of FIG. 7C.

Figure 7D:
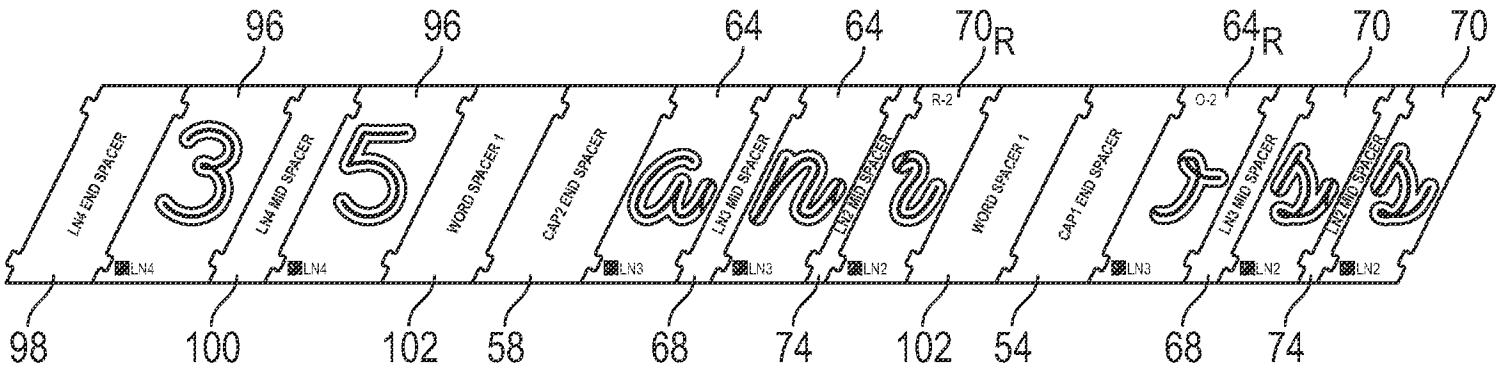
Figure 7E:
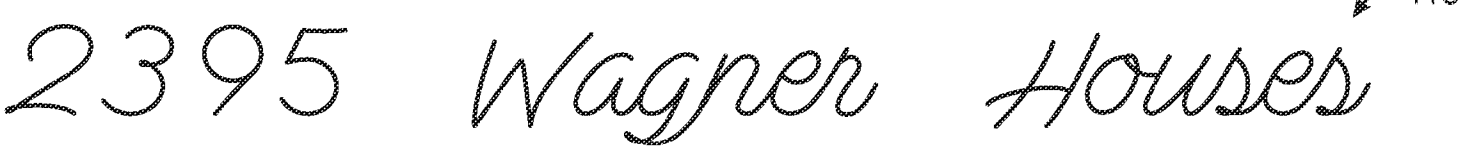
Figure 8:
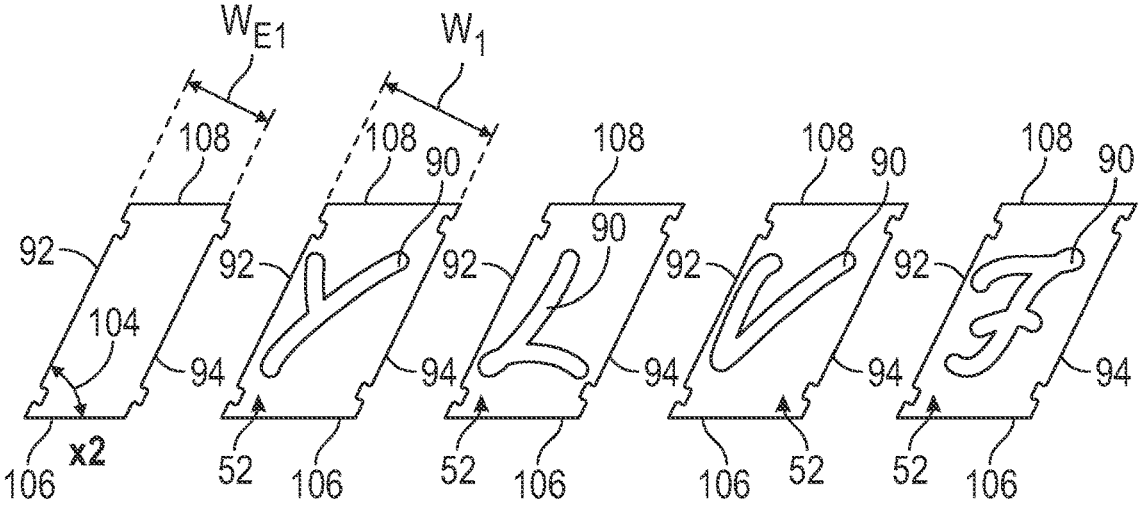
FIG. 8 is an enlarged plan view of the spacer and templates of FIG. 4A designated with the bracketed portion "8."
Figure 9:
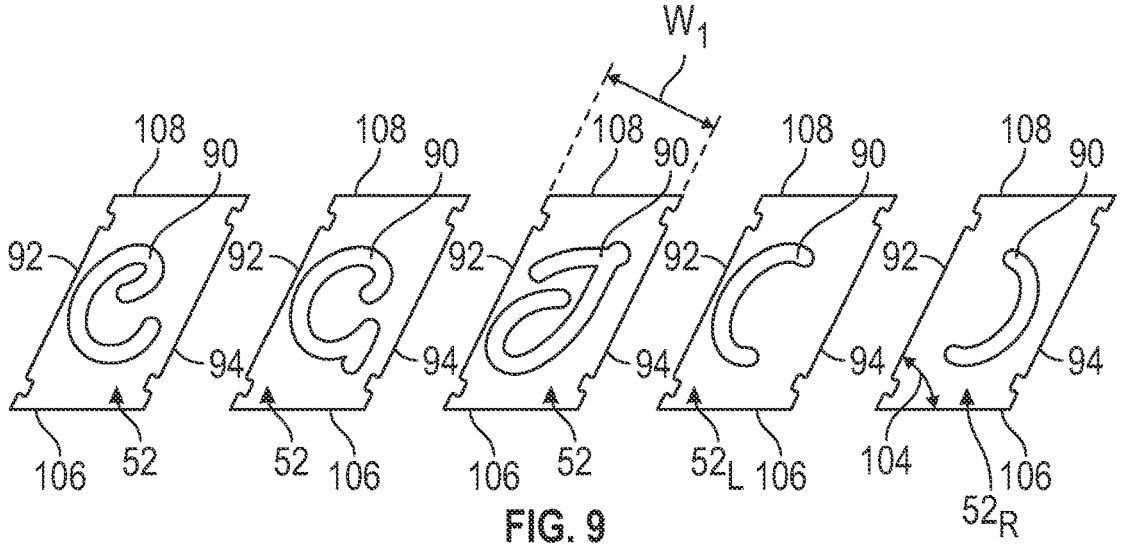
FIG. 9 is an enlarged plan view of the templates of FIG. 4A designated with the bracketed portion "9."
Figure 10:
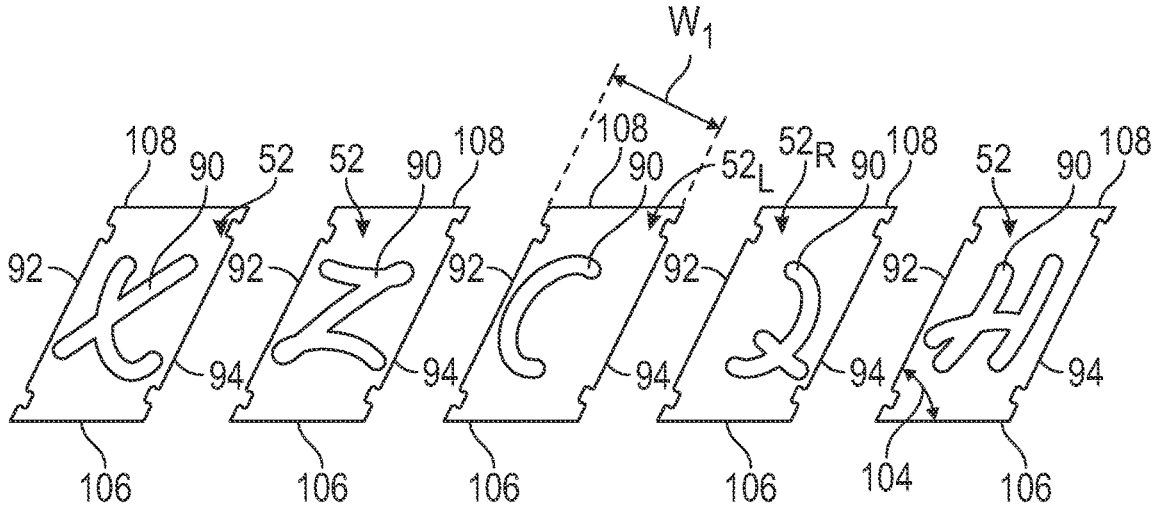
FIG. 10 is an enlarged plan view of the templates of FIG. 4A designated with the bracketed portion "10."
Figure 11:
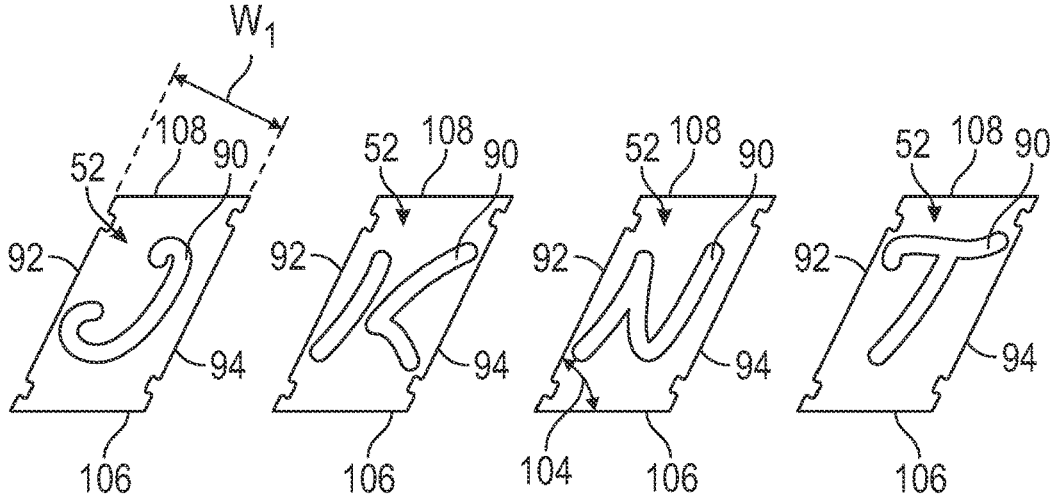
FIG. 11 is an enlarged plan view of the templates of FIG. 4A designated with the bracketed portion "11."

In the fourth pass of a routing tool over the templates and workpiece, a user routes in the grooves 90 of templates $\mathbf{70}_R$ and $\mathbf{64}_R$ of FIG. 7D. The pass shown in FIG. 7D completes characters using the second template of a two-pass template set, such as the set $\mathbf{70}_L$ and $\mathbf{70}_R$ for the lowercase letter "r" and the set $\mathbf{64}_L$ and $\mathbf{64}_R$ for the lowercase letter "o," to complete routing of the phrase 118.

Figure 27:
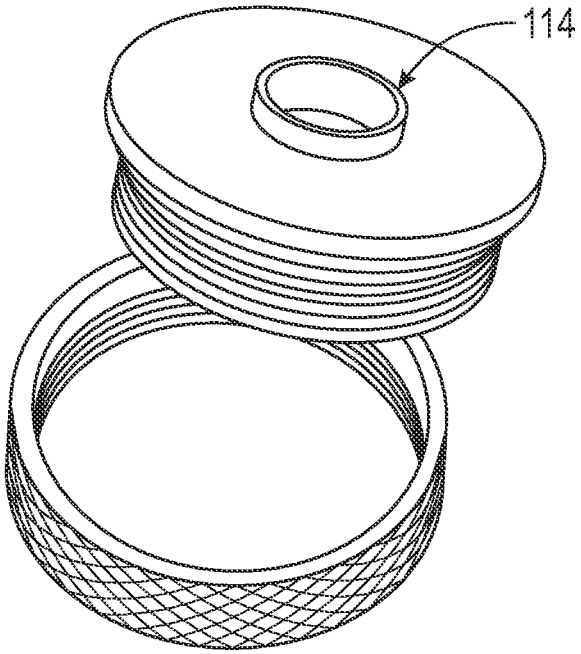
FIG. 27 is a perspective view of an exemplary guide bushing.

The interlocking templates, spacers and anchors include a front surface and a back surface that are substantially parallel to each other. The templates, spacers and anchors are typically manufactured from a polymeric material utilizing a molding process and/or a stamping process. In an exemplary embodiment, kit 50 includes a guide bushing 114, as shown in FIG. 27, that is configured to be secured to the router bit to prevent the router bit from gouging into the templates. The guide bushing 114 is typically constructed from a relatively soft metal, such as brass, to prevent erosion of the template surfaces. The guide bushing 114 can therefore be used with each template to guide the router in groove 90 to form the letter, number, symbol, or portion thereof.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa. All references mentioned in this disclosure are hereby incorporated by reference.

The invention claimed is:

1. A kit comprising:

a plurality of templates for letters, numbers or symbols configured for use in creating corresponding letters, numbers or symbols on a workpiece, wherein a first template of the plurality of templates has a first width;

a first end spacer configured to replace the first template in a subsequent pass in which the first template is at an end of a word, the first end spacer having a second width that is less than the first width;

a first middle spacer configured to replace the first template in the subsequent pass in which the first template is in a middle of the word, the first middle spacer having a third width that is less than the second width; and wherein a second template of the plurality of templates has a fourth width that is different from the first width.

2. The kit of claim 1 wherein the plurality of templates comprise complementary third and fourth templates for a character of the letters, numbers or symbols, wherein:

the third template comprises a first groove that defines a first portion of the character; and the fourth template comprises a second groove that defines a second portion of the character.

3. The kit of claim 2 wherein placing the third and fourth templates in a common position results in overlap of the first and second grooves.

4. The kit of claim 2 wherein the third and fourth templates have a common width.

5. The kit of claim 2 wherein the character has an island, wherein:

the first groove defines a first portion of a border of the island; and the second groove defines a second portion of the border of the island.

6. The kit of claim 2 wherein the third and fourth templates have different widths from each other.

7. The kit of claim 2 wherein:

the first portion of the character is a left portion of the character; and the second portion of the character is a right portion of the character.

8. The kit of claim 2 wherein:

the first portion of the character is a top portion of the character; and the second portion of the character is a bottom portion of the character.

9. The kit of claim 2 wherein:

the first portion of the character is a vertical portion of the character; and the second portion of the character is a horizontal portion of the character.

10. The kit of claim 1 wherein the first template is for a first capital letter and the second template is for a second capital letter that is different from the first capital letter.

11. The kit of claim 1 wherein the first template is for a first lowercase letter and the second template is for a second lowercase letter that is different from the first lowercase letter.

12. The kit of claim 1 wherein the first template is for a capital letter and the second template is for a lowercase letter.

13. The kit of claim 1 wherein the first template is for a first number and the second template is for a second number that is different from the first number.

14. The kit of claim 1 wherein the plurality of templates include complementary third, fourth and fifth templates for a character of the letters, numbers or symbols, wherein:

the third template includes a first groove that defines a first portion of the character;

the fourth template includes a second groove that defines a second portion of the character; and the fifth template includes the second groove that defines the second portion of the character, wherein the fourth and fifth templates have different widths from each other.

15. The kit of claim 14 wherein:

the first portion of the character is a vertical portion of the character; and the second portion of the character is a horizontal portion of the character.

16. The kit of claim 14 wherein:

the first portion of the character is a top portion of the character; and the second portion of the character is a bottom portion of the character.

17. The kit of claim 1, including first and second word anchors, wherein:

each of the first and second word anchors has a height that is greater than a height of the first template;

the first word anchor is configured for placement in front of the first template; and the second word anchor is configured for placement trailing the first template.

18. The kit of claim 17 wherein the first and second word anchors are structurally identical to each other.

19. The kit of claim 1 wherein at least one of the letters has a script typeface.

20. The kit of claim 1 wherein the first template includes opposite top and bottom edges and opposite left and right edges, wherein:

the top and bottom edges are parallel to each other;

the left and right edges are parallel to each other; and the left edge is slanted at an acute angle relative to the bottom edge.

* * * * *